US005603128A

United States Patent [19]

Nichols-Roy

[11] Patent Number: 5,603,128

[45] Date of Patent: Feb. 18, 1997

[54] DUAL-FLUSH CONTROL APPARATUS

[75] Inventor: David Nichols-Roy, Escondido, Calif.

[73] Assignee: Hunter Plumbing Products, San Marcos, Calif.

[21] Appl. No.: 477,932

[22] Filed: Jun. 7, 1995

[51] Int. Cl.[6] ..... E03D 1/14

[52] U.S. Cl. ..... 4/325; 4/410

[58] Field of Search ..... 4/325, 324, 407, 4/410

[56] References Cited

U.S. PATENT DOCUMENTS

| | | | |
|---|---|---|---|
| 3,324,482 | 6/1967 | Wustner | 4/325 |
| 3,331,084 | 7/1967 | Wustner | 4/325 |
| 3,365,730 | 1/1968 | Chiappetta . | |
| 3,546,715 | 12/1970 | Wustner . | |
| 4,000,526 | 1/1977 | Biela et al. . | |
| 4,149,283 | 4/1979 | Knudtson | 4/324 |
| 4,225,987 | 10/1980 | Goldmann et al. | 4/325 |
| 4,593,419 | 6/1986 | Derus | 4/324 |
| 4,750,221 | 6/1988 | Antunez, Jr. et al. | 4/410 |
| 4,945,580 | 8/1990 | Schmitt et al. | 4/325 |
| 5,004,462 | 4/1991 | Mahler | 4/325 |
| 5,228,144 | 7/1993 | Kightlinger | 4/324 |
| 5,259,074 | 11/1993 | Battle | 4/325 |
| 5,375,268 | 12/1994 | Chen | 4/325 |
| 5,459,884 | 10/1995 | Wesolowsky | 4/325 |

*Primary Examiner*—Charles E. Phillips
*Attorney, Agent, or Firm*—Baker, Maxham, Jester & Meador

[57] ABSTRACT

A multiple volume flush control apparatus for controlling a flush valve in a bottom of a flush tank, comprises a flush valve having a ventable buoyancy air chamber, a vent control assembly having a venting chamber communicating with the air chamber, a first valve for selectively activating the venting chamber for venting the air chamber at a first rate, and a second valve for selectively activating the venting chamber for venting the air chamber at a second rate.

20 Claims, 1 Drawing Sheet

DUAL-FLUSH CONTROL APPARATUS

BACKGROUND OF THE INVENTION

The present invention relates to plumbing installations, and more particularly, to dual flush systems used in gravity flush toilets and pertains particularly to an improved flush control apparatus.

For many decades household toilets have used a generally rectangular porcelain tank mounted immediately above a porcelain bowl from which about three and one-half to eight gallons of water are rapidly drained in order to flush the waste from the bowl into the sewer system. One very common design uses a flapper valve made of an elastomeric material that normally covers the drain outlet from the tank. When the flush handle on the outside of the tank is manually depressed the flapper valve is lifted and the head of water in the tank drains through the drain outlet into the bowl. The flapper valve is designed with an inverted air chamber so that it initially floats as it is lifted away from the drain outlet in the bottom of the tank. This allows sufficient flushing water to flow into the bowl even if the user immediately releases the flush handle.

A ballcock valve or toilet tank fill valve mounted in the tank is connected to a pressurized water line in the house. When the tank drains, a float ball connected to the ballcock valve descends. This turns the ballcock valve ON and it begins to refill the tank with water at a rate much slower than the rate at which water flows through the drain outlet. When the tank is nearly empty, the flapper valve closes. The tank continues to refill as the float ball connected to the ballcock rises. At the same time water from the ballcock valve enters an overflow tube and refills the bowl to the normal standing water level to provide a trap seal. Once the float ball reaches a predetermined height indicating that the tank is full, the ballcock valve completely turns OFF.

The foregoing conventional household toilet is wasteful and inefficient since a relatively large quantity of water is used to accomplish each flush. This is because the limited elevation of the tank provides only a modest water pressure head. The pressure head is obtained from the potential energy stored in the tank. As the body of water flows through the drain outlet of the tank it starts the siphoning action in the bowl and flushes the standing water in the bowl along with its waste contents into the sewer line.

Fresh water is becoming an increasingly valuable natural resource. Many geographic regions of the United States, such as Southern California, have experienced prolonged periods of drought. Arid parts of the country often take water from remote locations whose environments suffer as a result. For example, Los Angeles diverts large amounts of water from Mono Lake which has shrunk significantly since the 1930's. Furthermore, the more water that is flushed down toilets, the more volume of sewage there is that must be treated. Sewage delivery systems and treatment plants are expensive to construct and maintain. Treatment plants require large amounts of land and have offensive odors. Residents near any proposed sewage treatment site will often object vehemently.

According to a Dec. 19, 1980 report by the U. S Environmental Protection Agency (EPA), approximately 40% of the water used in a home is flushed down the toilet. The typical toilet in the U.S. uses between 3.5 and 7 gallons of water per flush. Effective Jan. 1, 1994, Federal law requires the installation of toilets in all new construction that use 1.6 gallons or less of water per flush. There is a critical need to ensure effective flushing in such toilets for sanitation reasons. Also, unless the flushing action in such low water volume toilets can be made efficient, users will flush them twice during each visit to the bathroom to ensure a complete flush, thereby negating the intended water savings.

There is also a critical need to design an apparatus to retrofit existing 3.5, 5 and 7 gallon toilets to lessen the amount of water used during each flush while maintaining an effective flush. Various approaches have been heretofore employed in regions subject to water rationing to reduce water consumption by conventional toilets. These have included lowering the tank level or introducing a brick or dam to decrease the water volume released during each flush. However, these approaches have generally been unsatisfactory because the consequent reduction in water flow into the bowl often results in incomplete flushing. Users then flush twice, compounding the waste of water.

Water shortages throughout the major portions of the United States have forced major water conservation efforts. These efforts have led to improvements in the toilet, such that as little as 1.6 gallons of water is utilized for a standard flush for solid waste removal.

Even further efforts at conservation have led to proposals for a dual flushing system, wherein a short flush is utilized to flush liquid wastes, and a long flush is utilized to flush solid wastes. The water is dispensed to the toilet bowl by way of a flush valve and seat, such as a flapper valve which allows the user to flush all or most of the tank water for a long flush, or just a portion of the tank water on the short flush. The flapper valve must be controlled to close prior to emptying the tank for the short flush. Once the toilet has been flushed, the tank is refilled automatically by a refill valve assembly connected to a water supply.

The typical flush valve assembly comprises a flapper valve having a normally downward opening air chamber which acts as a float when the flapper is raised off its seat to hold the flapper valve open when water is in the tank. This orients the air opening generally outwardly so that when the tank empties, the flapper follows the water level down to the point where the bulb and/or flange of the flapper are drawn into the flow stream which pulls the flapper down to seat, closing the flush valve. The refill mechanism is activated to refill the bowl and the tank.

Many different approaches to providing a dual flush system have been proposed. A major drawback to most of these is that they are complicated and expensive. Another drawback of many of them is that they do not function satisfactorily. One problem is that they do not account for the fact that successive short flushes typically will result in a bowl having less and less water, eventually not sealing the p-trap adequately. This invariably results in poor flush performance and failure to clear the bowl completely. It also results in wasting water by requiring double flushing to completely remove bowl contents when the trap is not fill at the start of the flush cycle.

Accordingly, it is desirable that an improved dual flush apparatus be available which is simple and effective, adequately providing for both long flushes and short flushes of a toilet, with maximum efficiency for the volume of water used.

SUMMARY OF THE INVENTION

It is the primary object of the present invention to provide an improved flush apparatus for effectively providing both long flushes and short flushes of a toilet, so as to more efficiently handle both solid and liquid waste with minimum water consumption.

To achieve this objective, a control system has been provided to evacuate air from a flapper at two different rates with a unique use of mechanical time delays.

In accordance with a primary aspect of the invention, multiple volume flush control apparatus for controlling a flush valve in a bottom of a flush tank, comprises a flush valve having a ventable buoyancy air chamber, a vent control assembly having a venting chamber communicating with said air chamber, first valve means for selectively activating said venting chamber for venting said air chamber at first rate, and second valve means for selectively activating said venting chamber for venting said air chamber at a second rate.

BRIEF DESCRIPTION OF THE PREFERRED EMBODIMENTS

The above and other objects and advantages of the present invention will be apparent from the following description when read in conjunction with the accompanying drawings wherein:

FIG. 1 is a top plan view in section of a dual flush apparatus in accordance with a preferred embodiment of the invention; and FIG. 2 is an elevation view in section of the actuated assembly of the embodiment of FIG. 1.

DETAILED DESCRIPTION OF THE PREFERRED EMBODIMENTS

Figure 1:
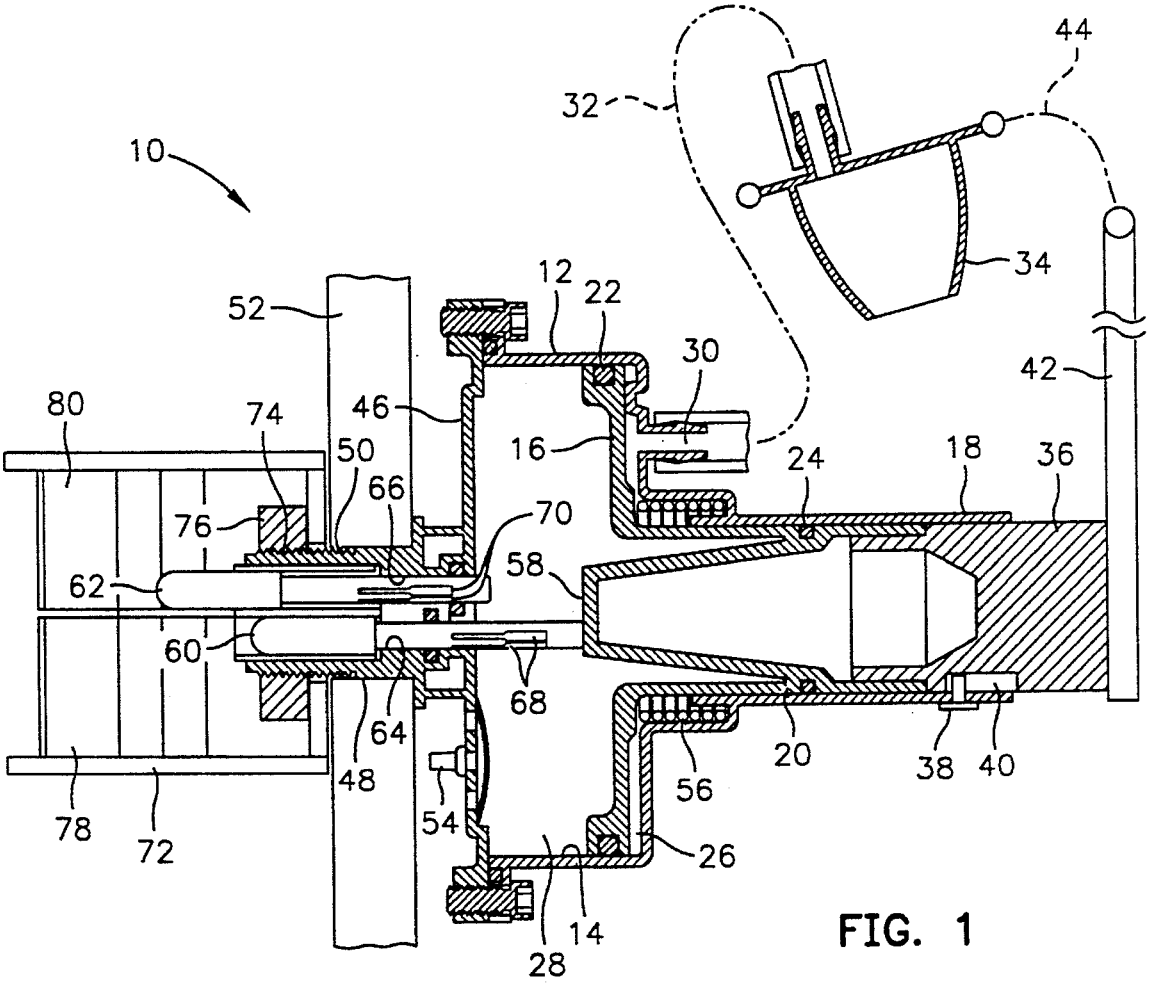

Referring to the drawings, particularly FIG. 1, there is illustrated a refill control apparatus in accordance with the preferred embodiment of the invention designated generally by the numeral 10.

Referring to FIG. 1 of the drawings, a dual-flush apparatus in accordance with the invention is illustrated and designated generally by the numeral 10. The apparatus is adapted to mount in the usual flush lever mounting opening in a typical flush tank of a typical toilet. The apparatus comprises a generally cylindrical housing 12 forming a cylinder with cylindrical walls 14 defining a cylinder chamber in which is reciprocally mounted a piston 16. The housing 12 includes a coaxial tubular extension 18 in which a coaxially extending shaft 20 of piston 16 is mounted. An 0-ring 22 seals the piston 16 in the cylindrical housing 14. An O-ring 24 seals the shaft 20 in the extension 18 of the housing. Diaphragm or bellow-type seals may be utilized in place of the O-rings to reduce frictional forces, if desirable.

The piston 16 divides the cylindrical vacuum or venting chamber into a chamber 26 and a control chamber 28. The chamber 26 communicates by means of a port 30 with a line or tube 32 which communicates with and vents a flapper valve 34 mounted in a flush tank.

An oscillating shaft 36 is mounted in the tubular extension 18 of the housing and includes a cam and follower arrangement, including a follower pin 38 engagable with a spiral cam 40 formed in the tubular extension 18. An arm or lever 42 is mounted on the outer end of the shaft 36 and is connected by a suitable chain or other link 44 to the valve 34 for lifting the valve from its seat. Reciprocation of the piston 16 causes rotation of the shaft or oscillation of the shaft 36 so that in its fully extended position, as shown in FIG. 1, the arm 42 lifts the valve 34 from its seat thereby flushing the commode.

The housing 12 includes a cover or closure 46 which contains a cylindrical extension member 48 substantially coaxial thereof which defines a valve housing. The valve housing 48 is sized to extend into and mount in a bore 50 of a flush tank wall 52. This bore is typically the mounting hole for the flush lever of a traditional flush tank.

A check valve 54 vents the chamber 28 as the piston is moved in a right-hand direction as illustrated in FIG. 1. A spring 56 biases the piston 16 normally in a left-hand direction, as viewed in FIG. 1. The piston 16 is formed with a centrally disposed flat portion of 58 disposed for engagement by means first and second valve means comprising a pair of actuating and control valves 60 and 62 respectively.

The actuator valves 60 and 62 comprise elongated stems which are mounted in cylindrical bores 64 and 66 formed in the housing extension or valve housing 48. The valve stem 60 is provided with a pair of valve slots or ports 68 positioned so that they are exposed to and vent the chamber 28 when the valve stem is pushed to its far right position, as illustrated in FIG. 1. Similarly, the valve stem 62 is provided with a pair of vent slots or ports 70 which are similarly exposed to the chamber 28 and are effective to vent the chamber when communicated therewith. The vent slots 68 and 70 will have different size and venting capacities so that they vent the chamber at different selective rates. One valve will provide for a slow return of the piston 16 and a long flush. The other valve will provide for a quicker return of the piston 16 and a short flush.

Figure 2:
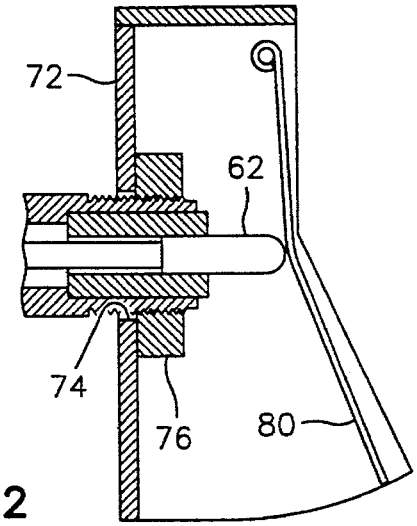

A button actuating assembly (FIGS. 1 and 2) includes a housing or frame 72 having a bore 74 mounted on the valve housing extension 48 and retained such as by means of a nut 76. A pair of actuating buttons or levers 78 and 80 are pivotly mounted in the frame 72 and engage the ends of the valves 60 and 62. These levers may be selectively biased inward to bias the piston 16 to the flush position, as illustrated in FIG. 1, wherein the arm 42 is raised to lift the flapper valve 34 from its seat. The flapper or flush valve 34 has the usual buoyancy air chamber that keeps the valve open until the chamber is vented.

In operation, once a valve 60 or 62 is actuated as illustrated in FIG. 1 biasing the piston to the right, the valve 34 is lifted and a flush begins. As the actuating button or lever is released, the valve 60 or 62 is in a position to begin venting chamber 28 allowing the spring 56 to begin forcing piston 16 to the left, as illustrated in FIG. 1. This draws air by vacuum by way of line 32 thereby slowly venting air from the buoyancy chamber of the valve 34. As the valve 60 is pushed toward the left by piston 16, more and more of the air is vented from the chamber 28 thereby drawing a vacuum in chamber 26 and venting the buoyancy chamber of the valve 34 allowing it to close and end the flush.

One valve 60 of the valves 60 and 62 is provided with larger slots than the other two, providing more rapid venting of the chamber 28 and thereby a more rapid venting of the buoyancy chamber of valve 34 for a short flush. The other of the valves is provided with slots which provide a slower venting of the chamber 28 and thereby a slower venting of the buoyancy chamber 34 of the valve 34. Thus, a selected long or short flush is provided.

While we have illustrated and described our invention by means of specific embodiments, it is to be understood that numerous changes and modifications may be made therein without departing from the spirit and the scope of the invention as defined in the appended claims.

I claim:

1. A multiple volume flush control apparatus for controlling a flush valve in a bottom of a flush tank, comprising:

a flush valve having a ventable buoyancy air chamber;

a vent control assembly having a venting chamber communicating with said air chamber;

first valve means for selectively activating said venting chamber for venting said air chamber at a first rate; and second valve means for selectively activating said venting chamber for venting said air chamber at a second rate.

2. An apparatus according to claim 1 wherein said venting chamber is a vacuum chamber for drawing air from said air chamber.

3. An apparatus according to claim 2 wherein said vacuum chamber comprises a cylinder, a piston mounted in said cylinder and a spring biasing said piston toward one end of said cylinder.

4. An apparatus according to claim 3 wherein said piston divides said cylinder into said vacuum chamber and a control chamber, and said piston is biased toward said control chamber.

5. An apparatus according to claim 4 wherein said first and second valve means are operative to selectively vent said control chamber for enabling said piston to move toward said control chamber.

6. An apparatus according to claim 4 wherein said first and second valve means are selectively operable to move said piston away from said control chamber toward said vacuum chamber.

7. An apparatus according to claim 6 further comprising a lift arm pivotally mounted on said vent control assembly, linkage means connecting an outer end of said lift arm to said flush valve, and cam means operatively connected to said piston for moving said arm upon movement of said piston for lifting said flush valve.

8. An apparatus according to claim 7 wherein said linkage means comprises a flexible vent tube connecting said air chamber to said vacuum chamber.

9. An apparatus according to claim 8 wherein:

said vent control assembly comprises a housing;

said cylinder is disposed in said housing;

said piston is reciprocally mounted in said cylinder dividing it into said control chamber and said vacuum chamber;

a spring mounted in said cylinder for biasing said piston toward said control chamber; and said vacuum chamber communicates with said air chamber and said first and second valves communicate with said vent chamber.

10. An apparatus according to claim 1 wherein said vent control assembly comprises a housing, wherein:

a cylinder is disposed in said housing;

a piston is reciprocally mounted in said cylinder dividing it into said control chamber and said vacuum chamber;

a spring mounted in said cylinder for biasing said piston toward said control chamber;

said vacuum chamber communicates with said air chamber; and said first valve means comprise a valve member which is mounted in said housing and extends into said control chamber for engaging and positioning said piston; and said second valve means comprise a valve member which extends into said control chamber for engaging and positioning said piston.

11. A dual water volume flush control apparatus for controlling a flush valve in a bottom of a flush tank, comprising:

a flush valve having a ventable buoyancy air chamber;

a vent control assembly comprising a housing;

a cylinder disposed in said housing;

a piston reciprocally mounted in said cylinder dividing it into a control chamber and a vacuum chamber;

a spring mounted in said cylinder for biasing said piston toward said control chamber;

said vacuum chamber communicates with said air chamber first valve means for selectively venting said control chamber and said air chamber at a first rate; and second valve means for selectively venting said control chamber and said air chamber at a second rate.

12. A refill apparatus according to claim 11 wherein said first and second valve means are selectively operable to move said piston away from said control chamber toward said vacuum chamber.

13. A refill apparatus according to claim 12 further comprising a lift arm pivotally mounted on said vent control assembly, linkage means connecting an outer end of said lift arm to said flush valve, and cam means operatively connected to said piston for moving said arm upon movement of said piston for lifting said flush valve.

14. A refill apparatus according to claim 11 wherein said further comprising a lift arm pivotally mounted on said vent control assembly, linkage means connecting an outer end of said lift arm to said flush valve, and cam means operatively connected to said piston for moving said arm upon movement of said piston for lifting said flush valve.

15. A refill apparatus according to claim 14 wherein:

said first valve means comprise a valve member which is mounted in said housing and extends into said control chamber for engaging and positioning said piston; and said second valve means comprise a valve member which extends into said control chamber for engaging and positioning said piston.

16. A refill apparatus according to claim 11 wherein:

said first valve means comprise a valve member which is mounted in said housing and extends into said control chamber for engaging and positioning said piston; and said second valve means comprise a valve member which extends into said control chamber for engaging and positioning said piston.

17. A refill apparatus according to claim 16 wherein:

said first valve comprises an elongated stem that extends into said control chamber and includes an end for engaging and positioning said piston, and a vent groove along a side thereof for controllably venting said control chamber; and said second valve comprises a elongated stem that extends into said control chamber and having an end for engaging and positioning said piston and a vent groove one side thereof for controllably venting said control chamber.

18. An actuator control assembly comprising:

a flush valve having a buoyancy air chamber, and adapted to be mounted on a seat to selectively close a drain outlet;

a housing having a cylinder disposed therein;

a piston reciprocally mounted in said cylinder dividing it into a control chamber and a vacuum chamber;

a spring mounted in said cylinder for biasing said piston toward said control chamber;

a flexible conduit communicating said vacuum chamber with said air chamber;

a first valve mounted in said housing for selectively venting said control chamber at first rate; and a second valve mounted in said housing for selectively venting said control chamber at a second rate.

19. A refill apparatus according to claim 18 wherein said further comprising a lift arm pivotally mounted on said vent control assembly, linkage means connecting an outer end of said lift arm to said flush valve, and cam means operatively connected to said piston for moving said arm upon movement of said piston for lifting said flush valve.

20. A refill apparatus according to claim 19 wherein:

said first valve comprises an elongated stem that extends into said control chamber and includes an end for engaging and positioning said piston, and a vent groove along a side thereof for controllably venting said control chamber; and said second valve comprises a elongated stem that extends into said control chamber and having an end for engaging and positioning said piston and a vent groove along one side thereof for controllably venting said control chamber.

* * * * *